US011377700B2

(12) United States Patent
Blostein et al.

(10) Patent No.: US 11,377,700 B2
(45) Date of Patent: Jul. 5, 2022

(54) METHOD FOR OPERATING AN IRON- OR STEELMAKING- PLANT

(71) Applicant: L'Air Liquide, Société Anonyme pour l'Etude et l'Exploitation des Procédés Georges Claude, Paris (FR)

(72) Inventors: Philippe Blostein, Paris (FR); Mike Grant, Bad Homburg (DE)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 96 days.

(21) Appl. No.: 16/628,171

(22) PCT Filed: Jul. 2, 2018

(86) PCT No.: PCT/EP2018/067820

§ 371 (c)(1),
(2) Date: Jan. 2, 2020

(87) PCT Pub. No.: WO2019/007908

PCT Pub. Date: Jan. 10, 2019

(65) Prior Publication Data

US 2020/0149124 A1 May 14, 2020

(30) Foreign Application Priority Data

Jul. 3, 2017 (EP) ..... 17305860

(51) Int. Cl.
*C21B 5/06* (2006.01)
*F27B 1/10* (2006.01)
(Continued)

(52) U.S. Cl.
CPC ..... *C21B 5/06* (2013.01); *F27B 1/10* (2013.01); *F27B 1/16* (2013.01); *F27D 7/02* (2013.01); *C21B 2100/40* (2017.05)

(58) Field of Classification Search
CPC ..... C21B 2100/40; C21B 5/06; F27B 1/10; F27B 1/16; F27D 7/02
(Continued)

(56) References Cited

U.S. PATENT DOCUMENTS 3,884,677 A * 5/1975 Wenzel ..... C21B 5/06 75/462
5,234,490 A * 8/1993 Kundrat ..... C21B 5/06 75/464

(Continued)

FOREIGN PATENT DOCUMENTS

CN 102876824 1/2013
CN 105899686 8/2016

(Continued)

OTHER PUBLICATIONS

International Search Report and Written Opinion for corresponding PCT/EP2018/067820, dated Aug. 30, 2018.

*Primary Examiner* — Scott R Kastler
*Assistant Examiner* — Michael Aboagye
(74) *Attorney, Agent, or Firm* — Elwood L. Haynes

(57) ABSTRACT

A method of operating an ironmaking or steelmaking plant with low $CO_2$-emissions is provided. Hydrogen and oxygen are generated by water decomposition and at least part of the generated hydrogen is injected as a reducing gas into one or more ironmaking furnaces with off-gas decarbonation and reinjection into the furnaces of at least a significant part of the decarbonated off-gas and at least part of the generated oxygen is injected as an oxidizing gas in the one or more ironmaking.

15 Claims, 2 Drawing Sheets

(51) Int. Cl.
*F27D 7/02* (2006.01)
*F27B 1/16* (2006.01)

(58) Field of Classification Search
USPC ..... 266/47, 197, 168; 75/464, 468, 458
See application file for complete search history.

(56) References Cited

U.S. PATENT DOCUMENTS

| | | | | |
|---|---|---|---|---|
| 9,863,013 | B2 * | 1/2018 | Cameron | C21B 9/00 |
| 10,054,366 | B2 * | 8/2018 | Blostein | C21B 5/006 |
| 10,072,312 | B2 * | 9/2018 | Grant | C21B 9/14 |
| 10,106,863 | B2 * | 10/2018 | Inada | F27B 1/10 |
| 2010/0230872 | A1 | 9/2010 | Devaux et al. | |
| 2016/0326604 | A1 | 11/2016 | Inada et al. | |
| 2016/0348195 | A1 | 12/2016 | Achatz et al. | |

FOREIGN PATENT DOCUMENTS

| | | | | |
|---|---|---|---|---|
| TW | 201239098 | | 10/2012 | |
| WO | WO 2011 116141 | | 3/2011 | |
| WO | WO2011116141 | * | 9/2011 | F27D 7/02 |
| WO | WO 2013 056870 | | 4/2013 | |
| WO | WO 2015 090900 | | 11/2014 | |

* cited by examiner

METHOD FOR OPERATING AN IRON- OR STEELMAKING- PLANT

CROSS REFERENCE TO RELATED APPLICATIONS

This application is a 371 of International PCT Application No. PCT/EP2018/067820, filed Jul. 2, 2018, which claims priority to European Patent Application No. 17305860, filed Jul. 3, 2017, the entire contents of which are incorporated herein by reference.

BACKGROUND

The present invention relates to the production of iron or steel in an iron- or steelmaking plant in which iron is produced from iron ore.

There are currently two paths to making iron from iron ore:

- the production of molten iron from iron ore in a blast furnace (BF) charged with iron ore and coke and into which combustible matter, such as coal, may also be injected as fuel and reducing agent; and
- the production of sponge iron or direct reduced iron (DRI) in a so-called direct reduction process whereby iron oxides in the iron ore are reduced in the solid state without melting.

Liquid or solidified iron from blast furnaces (known as "pig iron") contains high levels of carbon. When pig iron is used to produce steel, it must be partially decarburized and refined, for example in a converter, in particular in a Linz-Donawitz Converter (in short L-D converter) also known in the art as a basic oxygen furnace (BOF).

In the absence of special measures during the direct reduction process, DRI contains little or no carbon. In order to produce steel from DRI, the DRI is melted in a smelter or electric arc furnace (EAF) and additives are added to the melt so as to obtain steel with the required composition.

The production of iron in blast furnaces remains by far the most important method of producing iron from iron ore and iron produced in blast furnaces remains the main iron source for steel production.

The iron and steel industry accounts for a significant percentage of the world's $CO_2$ emissions.

Significant efforts have been made to reduce these emissions and therefore the "carbon footprint" of the iron and steel industry.

It has, for example, been suggested to inject hydrogen as a reducing in iron ore reduction furnaces.

For example, in WO-A-2011/116141 it has been proposed to produce sponge iron from iron ore by means of hydrogen in a two-step reduction process:

$$3Fe_2O_3+H_2 \rightarrow 2Fe_3O_4+H_2O \text{ and}$$

$$Fe_3O_4+4H_2 \rightarrow 3Fe+4H_2O.$$

Heat is supplied to the iron ore direct reduction furnace according to WO-A-2011/116141 by means of a separate oxy-hydrogen flame generator which operates at an $H_2$:$O_2$ ratio between about 1:1 and 5:1 and at a temperature of less than about 2800° C. Said direct reduction furnace is described as producing steam as a by-product and not generating any $CO_2$ emissions.

No further details are provided in WO-A-2011/116141 regarding the structure or operation of said direct reduction furnace and to date the proposed technology has not been industrially exploited.

There have likewise been many proposals to inject hydrogen into blast furnaces, alone or in combination with other reducing gases, as a complementary reducing agent in addition to coke.

Various attempts in industrial iron- or steelmaking installations with different earlier described technologies involving hydrogen injection in blast furnaces have failed either to achieve a significant coke or other hydrocarbon fuel consumption at constant melt rates of the blast furnace or to achieve a significant increase in production at constant coke/hydrocarbon load. For this reason, the injection of hydrogen into blast furnaces has thus far not met with industrial success.

It has now been found that, in spite of the above and under certain specific conditions, injected hydrogen can be an effective reducing agent in a process for producing molten iron from iron ore in an industrial furnace. More specifically, in accordance with the present invention, it has been found that, under certain specific conditions, injected hydrogen can be an effective iron-ore reducing agent in processes whereby the furnace is charged with iron ore and coke, whereby off-gas from the furnace is decarbonated and whereby at least a significant part of the decarbonated off-gas is recycled back to the furnace.

The present invention relates more specifically to a method of operating an iron- or steelmaking plant comprising an ironmaking furnace set which consists of one or more furnaces in which iron ore is transformed into liquid hot metal by means of a process which includes iron ore reduction, melting and off-gas generation. Said iron- or steelmaking plant optionally also comprises a converter downstream of the ironmaking furnace set.

A method of this type was developed during the European ULCOS (Ultra Low $CO_2$ Steelmaking) research project funded by the European Commission and is commonly referred to as the "top gas recycling blast furnace" or "TGRBF".

In a TGRBF, substantially all of the $CO_2$ is removed from the blast furnace gas (BFG), also known as top gas, and substantially all of the remaining decarbonated blast furnace gas is recycled and reinjected into the blast furnace.

In this manner, coke consumption and $CO_2$ emissions are reduced.

Furthermore, in TGRBFs, oxygen is used as the oxidizer for combustion instead of the conventional (non-TGRBF) blast air or oxygen-enriched blast air.

The validity of the TGRBF concept has been demonstrated in a pilot scale blast furnace.

The ULCOS project demonstrated that approximately 25% of the $CO_2$ emissions from the process could be avoided by recycling decarbonated BFG.

In order to achieve the targeted 50% reduction of $CO_2$ emissions, the $CO_2$ removed from the (BFG) of the TGRBF must be sequestered and reused or stored (for example underground). Given the limited demand for $CO_2$ and the overwhelming excess of $CO_2$ available, storage is the dominant currently feasible option. However, not only may the transport of the $CO_2$ to its storage location and the storage itself entail significant costs, due to technical and social reasons, there are also insufficient locations where storage of significant amounts of $CO_2$ is both geologically sound and legally permitted.

There therefore remains a need to find other methods to achieve further reductions of $CO_2$ emissions during iron production from iron ore while maintaining furnace productivity and product quality.

Thereto, the present invention provides a method of operating an iron- or steelmaking plant comprising an ironmaking furnace set (or IFS) which consists of one or more furnaces in which iron ore is transformed into liquid hot metal by means of a process which includes iron ore reduction, melting and off-gas generation.

The off-gas is also referred to in the art as "top gas" (TG) or as "blast furnace gas" (BFG) when the furnace or furnaces of the set is/are blast furnaces.

The iron- or steelmaking plant optionally also comprises a converter, and in particular a converter for converting the iron generated by the IFS into steel. The plant may also include other iron- or steelmaking equipment, such as a steel reheat furnace, an EAF, etc.

In accordance with the invention:

(a) the IFS is charged with iron ore and coke.

(b) oxidizing gas is injected into the IFS. The oxidizing gas is also referred to in the art as "blast" when the furnace or furnaces of the set is/are blast furnaces.

(c) the generated off-gas is decarbonated downstream of the IFS. A $CO_2$-enriched tail gas stream and a decarbonated off-gas stream are thereby obtained. According to the present invention, the decarbonated off-gas stream contains not more than 10% vol $CO_2$. Decarbonation of the generated off-gas is preferably conducted so that the decarbonated off-gas stream contains not more than 3% vol $CO_2$.

(d) at least part of the decarbonated off-gas stream is injected back into the IFS as a reducing gas recycle stream. According to the present invention, at least 50% of the decarbonated off-gas stream is thus injected back into the IFS.

In addition, in accordance with the present invention:

(e) hydrogen and oxygen are generated by means of water decomposition, (f) at least part of the thus generated hydrogen is injected into the ironmaking furnace set.

(g) at least part of the generated oxygen is also injected as oxidizing gas into the ironmaking furnace set and/or the converter, if present.

Preferably, all or part of the generated hydrogen which is injected into the ironmaking furnace set is mixed with the reducing gas recycle stream before the gas mixture of recycled reducing gas and generated hydrogen so obtained is injected into the ironmaking furnace set.

By means of the invention, reliance on coke and other hydrocarbon-based fuels is reduced as well as the $CO_2$ emissions per tonne of hot iron produced.

It will be appreciated that "injection into the IFS" means injection into the one or more furnaces of which the IFS consists.

The method according to the present invention thus uses a non-carbon-based hydrogen source for the optimization of the operation of the IFS by means of hydrogen injection, thereby reducing the $CO_2$ emissions of the IFS. In addition, the same non-carbon-based hydrogen source also generates oxygen which is likewise used to optimize the operation of the IFS and/or of other steelmaking equipment in the plant, such as a converter. The combined use of the generated hydrogen and the generated oxygen significantly reduces the costs associated with hydrogen injection into the IFS. In addition, by using water decomposition as the hydrogen source, no waste products are generated, which again reduces the costs of waste disposal.

The reducing stream can be injected into the IFS by means of tuyeres. In the case of blast furnace(s) said reducing stream can more specifically be injected via hearth tuyeres, and optionally also via shaft tuyeres.

As indicated above, the IFS can include or consist of one or more blast furnaces. In that case at least part or all of the oxidizing gas injected into the blast furnace(s) is injected in the form of blast, preferably in the form of hot blast.

When only part of the oxidizing gas injected into the IFS in step (b) consists of generated oxygen, i.e. when the oxidizing gas injected into the IFS consists in part of oxygen generated in step (e) and in part of oxygen-containing gas from a different source, whereby said oxygen-containing gas may in particular be air, oxygen or oxygen-enriched air, the oxygen generated in step (e) may be injected into the IFS:

- separately from said oxygen-containing gas,
- mixed with said oxygen-containing gas or
- partially separately from the oxygen-containing gas and partially mixed with said oxygen-containing gas.

Thus, in the case of one or more blast furnaces, the blast, preferably hot blast, which is injected into the blast furnace in step (b) may advantageously comprises at least part or even all of the oxygen generated in step (e).

Likewise, when the plant includes a converter, the oxidizing gas injected into the converter for decarburizing a metal melt usefully consists at least in part or entirely of the oxygen generated in step (e).

The oxidizing gas injected into the IFS in step (b) is preferably substantially free of inert gases such as $N_2$. The oxidizing gas advantageously contains less than 20% vol, more preferably less than 10% vol and even more preferably at most 5% vol $N_2$. In addition, the oxidizing gas advantageously contains at least 70% vol, more preferably at least 80% vol and even more preferably at least 90% vol and up to 100% vol 02.

During water decomposition, separate streams of oxygen and hydrogen are normally generated. No additional separation steps are therefore required after step (e) for separation of the generated oxygen from the generated hydrogen before mixing at least part of the generated hydrogen with the reducing gas recycle stream in step (f), respectively before the injection of at least part of the generated oxygen into the blast furnace and/or the converter in step (g) of the method according to the invention. In addition, the oxygen and hydrogen streams are generally high-purity streams, containing typically at least 80% vol, preferably at least 90% vol and more preferably at least 95% vol and up to 100% vol $O_2$, respectively $H_2$.

Methods of water decomposition suitable for hydrogen and oxygen generation in step (e) include biological and/or electrolytic water decomposition.

A known form of biological water decomposition is photolytic biological (or photobiological) water decomposition, whereby microorganisms—such as green microalgae or cyanobacteria—use sunlight to split water into oxygen and hydrogen ions. At present, electrolytic water decomposition methods are preferred, as the technology is well-established and suited for the production of large amounts of hydrogen and oxygen.

As is known in the art, an electrolyte is advantageously added to the water in order to promote electrolytic water decomposition, Examples of such electrolytes are sodium and lithium cations, sulfuric acid, potassium hydroxide and sodium hydroxide.

Different types of water electrolysis, which are known in the art, may be used for the hydrogen and oxygen generation during step (e). These include:

- alkaline water electrolysis, whereby water electrolysis takes place in an alkaline water solution,
- high-pressure water electrolysis, including ultrahigh-pressure water electrolysis, whereby water electrolysis takes place at pressures above atmospheric pressure, typically from 5 to 75 MPa, preferably from 30 to 72 MPa for ultrahigh-pressure water electrolysis and from 10 to 25 MPa for high-pressure (but not ultrahigh-pressure) water electrolysis. An important advantage of high-pressure electrolysis is that the additional energy required for operating the water electrolysis is less than the energy that would be required for pressurizing the hydrogen and/or the oxygen generated by ambient pressure water electrolysis to the same pressures. If the pressure at which the hydrogen or oxygen is generated exceeds the pressure at which the gas is to be used, it is always possible to depressurize the generated gas to the desired pressure, for example in an expander.

High-temperature water electrolysis, whereby water electrolysis takes place at temperatures above ambient temperature, typically at 50° C. to 1100° C., preferably at 75° C. to 1000° C. and more preferably at 100° C. to 850° C. High-temperature water electrolysis is generally more energy efficient than ambient temperature water electrolysis. In addition, for applications whereby hydrogen or oxygen is used or preferably used at temperatures above ambient temperature, as is often the case for applications in the iron or steel industry, such as when hydrogen and or oxygen is injected into a blast furnace or when oxygen is injected into a converter, no or less energy is required to bring the gas to the desired temperature.

Polymer-electrolyte-membrane water electrolysis, which was first introduced by General Electric and whereby a solid polymer electrolyte is responsible for the conduction of protons, the separation of hydrogen and oxygen and the electrical insulation of the electrodes.

Combinations of said water electrolysis techniques are also possible.

Thus, whereas in step (e) the water electrolysis may take place at ambient pressure, high-pressure water electrolysis may also be used to generate hydrogen and/or oxygen at a pressure substantially above ambient pressure, e.g. at pressures from 5 to 75 MPa, in particular from 30 to 72 MPa or from 10 to 25 MPa.

Whereas in step (e) the water electrolysis may be conducted at ambient temperature, high-temperature water electrolysis generating hydrogen and/or oxygen at temperatures from 50° C. to 1100° C., preferably from 75° C. to 1000° C. and more preferably from 100° C. to 850° C. may advantageously also be used.

The electricity used for the water decomposition in step (e) is preferably obtained with a low carbon footprint, more preferably without generating $CO_2$ emissions. Examples of $CO_2$-free electricity generation include hydropower, solar power, wind power and tidal power generation, but also geothermic energy recovery and even nuclear energy.

The method advantageously also includes the step of:

(a) heating the reducing gas recycle stream or the mixture of generated hydrogen with the reducing gas recycle stream in hot stoves to a temperature between 700° C. and 1300° C., preferably between 850° C. and 1000° C. and more preferably between 880° C. and 920° C. upstream of the IFS.

In that case, the method preferably also includes the step of:

(b) producing a low-heating-value gaseous fuel with a heating value of from 2.8 to 7.0 MJ/Nm$^3$ and preferably from 5.5 to 6.0 MJ/Nm$^3$, which contains (i) at least a portion of the tail gas stream and (ii) a second part of the generated hydrogen, said low-heating-value gaseous fuel being used to heat the hot stoves.

At least part of the $CO_2$-enriched tail gas may be captured for sequestration and/or use in a further process. The iron- or steelmaking plant may include one or more storage reservoirs for the storage of the $CO_2$ separated off in step (c) of the method according to the invention prior to sequestration or further use.

The generated hydrogen and/or the mixture of generated hydrogen with the top-gas recycle stream are typically injected into the blast furnace(s) via hearth tuyeres, and optionally also via shaft tuyeres.

The oxidizing gas injected into the IFS is typically a high-oxygen oxidizing gas, i.e. an oxidizing gas having an oxygen content higher than the oxygen content of air and preferably a high-oxygen oxidizing gas as defined above. Air may nevertheless be used to burn the low heating-value gaseous fuel for heating the hot stoves.

Between 80 and 90% vol of the decarbonated off-gas stream or decarbonated blast furnace gas stream is preferably thus heated in the hot stoves and injected into the IFS.

For the decarbonation of the off-gas, respectively blast furnace gas, in step (c), a VPSA (Vacuum Pressure Swing Adsorption), a PSA (Pressure Swing Adsorption) or a chemical absorption unit, for example with use of amines, may be used.

The hydrogen generated in step (e) consists preferably for at least 70% vol of $H_2$ molecules, preferably for at least 80% vol and more preferably for at least 90% vol, and up to 100% vol. This can be readily achieved as the hydrogen generation process of step (e) does not rely on hydrocarbons as starting material.

According to a preferred embodiment, all of the oxygen injected into the IFS and/or converter consists of oxygen generated in step (e). Embodiments whereby all of the oxygen injected into the IFS consists of oxygen generated in step (e) are particularly useful.

However, oxygen from other sources, in particular from an Air Separation Unit (ASU) may also be injected into the IFS and/or into the converter (when present). For example, oxygen generated by ASUs using cryogenic distillation, Pressure Swing Adsorption (PSA) or Vacuum Swing Adsorption (VSA) may be injected into the IFS and/or into the converter. The iron- or steelmaking plant may include one or more reservoirs for storing oxygen until it is used in the plant.

Parts of the oxygen generated in step (e) of the method may also advantageously be used in other installations of the iron- or steelmaking plant, such as, for example, as oxidizing gas in an electric arc furnace (EAF) and/or in a continuous steel caster, when present, or in other installations/processes in the plant that require oxygen. Alternatively or in combination therewith, part of the generated oxygen not injected into the blast furnace or the converter may be sold to generate additional revenue.

Water decomposition generates hydrogen and oxygen at a hydrogen-to-oxygen ratio of 2 to 1.

In accordance with a preferred embodiment of the invention, all of the hydrogen injected into the IFS, other than the hydrogen present in the off-gas recycle stream, is hydrogen generated by water decomposition in step (e). Likewise, preferably all of the oxygen injected into the IFS and/or into the converter in step (g) is oxygen generated by water decomposition in step (e). Preferably, all of the hydrogen generated in step (e) which is injected into the IFS is mixed with the off-gas recycle stream before being injected into the ironmaking furnace set.

In other words, in these cases the water decomposition of step (e) can meet the entire oxygen requirement of the IFS, of the converter, respectively of the IFS and the converter.

According to a useful embodiment, the ratio between (i) the hydrogen generated in step (e) and injected into the IFS (i.e. excluding any hydrogen present in the off-gas recycle stream), and (ii) the oxygen generated in step (e) and injected into the IFS and/or the converter in step (g) (i.e. excluding oxygen from other sources, such as any oxygen present in air, such as blast air, that may also be injected into the IFS as oxidizing gas), is substantially equal to 2, i.e. between 1.50 and 2.50, preferably between 1.75 and 2.25, and more preferably between 1.85 and 2.15.

According to a specific advantageous embodiment, all of the oxygen injected into the IFS is oxygen generated by water decomposition in step (e) and the ratio between (i) the hydrogen generated in step (e) and injected into the IFS and (ii) the oxygen generated in step (e) and injected into the IFS in step (g) is substantially equal to 2, i.e. between 1.5 and 2.5, preferably between 1.75 and 2.25, more preferably between 1.85 and 2.15.

In such a case, reliance for said gas injections on external oxygen or hydrogen sources other than the water decomposition of step (e), can be substantially avoided. Nevertheless, the iron- or steelmaking plant may include one or more reservoirs for storing hydrogen for use in the plant, for example as a hydrogen back-up or to meet higher hydrogen demands at certain stages of the iron- or steelmaking process, such as when the demand for (hot) metal is higher.

When the ratio between (i) the generated hydrogen injected into the IFS and the generated oxygen injected into the IFS and/or converter is not substantially equal to 2, it may still be possible to arrive at an overall generated hydrogen—to —generated oxygen consumption ratio which is substantially equal to 2 by using any surplus of generated gas (which may be generated oxygen or generated hydrogen) in other installations or processes of the plant. Thus, in embodiments of the present invention whereby at least part or the generated hydrogen and/or at least part of the generated oxygen is used (consumed) in processes or installations of the iron- or steelmaking plant other than the IFS, respectively the IFS and/or the converter, the ratio between (i) the hydrogen generated in step (e) used in the plant and (ii) the oxygen generated in step (c) used in the plant can still usefully be substantially equal to 2, i.e. between 1.5 and 2.5, preferably between 1.75 and 2.25, more preferably between 1.85 and 2.15.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DETAILED DESCRIPTION OF PREFERRED EMBODIMENTS

Figure 1:
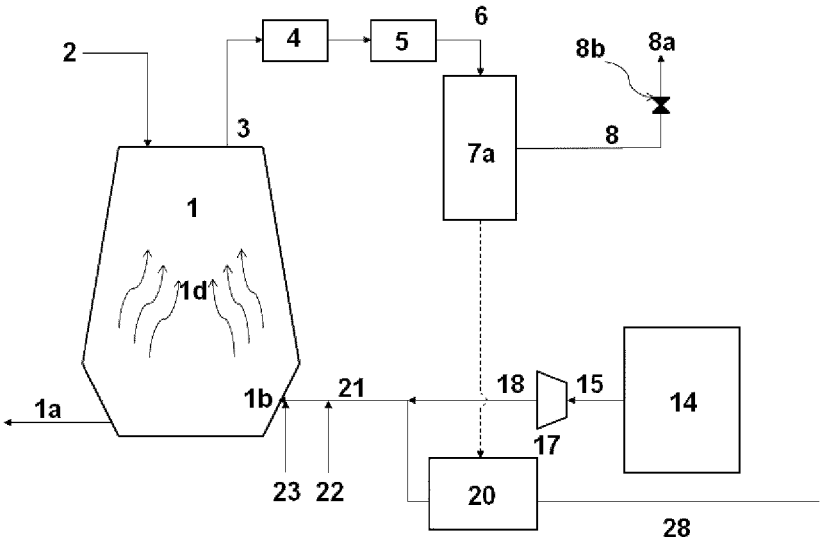
Figure 1 (prior art).
FIG. 1 schematically illustrates a prior art steelmaking plant.
Figure 2:
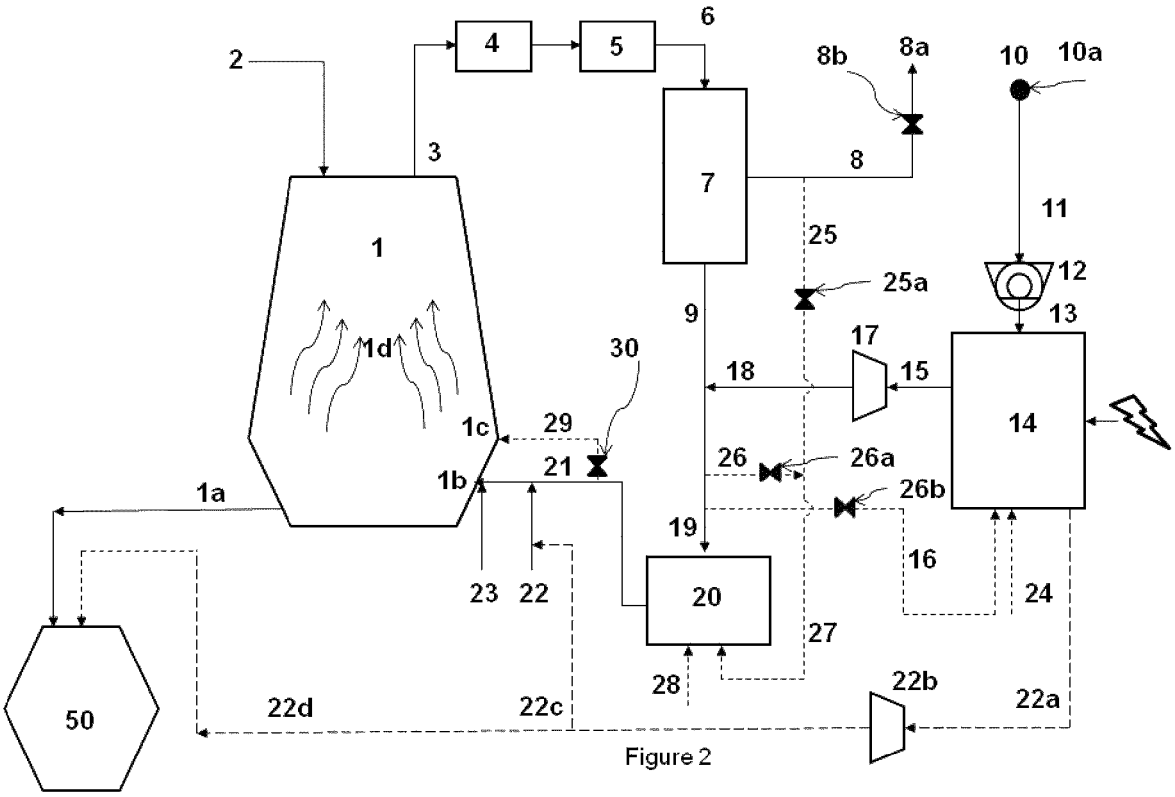
FIG. 2 schematically illustrates an embodiment of the invention.

The present invention and its advantages are further clarified in the following example, reference being made to FIGS. 1 and 2, whereby FIG. 1 schematically illustrates a prior art steelmaking plant whereby the IFS consists of one or more non-TGRBFs (only one blast furnace is schematically represented and in the corresponding description reference is made to only one non-TGRBF) and FIG. 2 schematically illustrates an embodiment of the method according to the invention applied to a steelmaking plant whereby the IFS consists of one or more TGRBFs (only one TGRBF is represented and in the corresponding description reference is also made to only one TGRBF), whereby identical reference numbers are used to indicate identical or analogous features in the two figures.

FIG. 1 which shows a prior art conventional blast furnace 1 without top gas decarburization or recycling. Blast furnace 1 is charged from the top with coke and iron ore 2 which descend in the blast furnace 1.

Air 28 is preheated in hot stoves 20 before being injected into blast furnace 1 via hearth tuyeres 1*b*. Substantially pure oxygen 22 can be added to blast air 28 via the hearth tuyeres 1*b* or upstream of the hot stoves 20.

Pulverized coal (or another organic combustible substance) 23 is typically also injected into the blast furnace 1 by means of hearth tuyeres 1*b*.

The air 28, and, if added, the substantially pure oxygen 22 and the pulverized coal (or another organic fuel) 23 combine inside the blast furnace so as to produce heat by combustion and reducing gas 1*d* (in contact with the coke present in solid charge 2). Reducing gas 1*d* ascends the inside of blast furnace 1 and reduces the iron oxides contained in the ore to metallic iron. This metallic iron continues its descent to the bottom of the blast furnace 1 where it is removed (tapped) 1*a* along with a slag containing oxide impurities.

The off-gas, better known as blast furnace gas (BFG), 3 exits the blast furnace 1 and travels to an initial dust removal unit 4 where large particles of dust are removed. It continues to a second dust removal system 5 that removes the fine dust particles to produce a "clean gas" 6. The clean gas 6 is optionally dewatered before entering the BFG distribution system 7*a* where part of the clean gas 6 can be sent distributed to the hot stoves 20, where it is used as a fuel, and part 8 of the clean gas 6 can be sent to other locations 8*a* of the steel plant for various uses. The flow of BFG to the one or more other locations 8*a* is controlled by control valve system 8*b*.

Hydrogen, CO or a mixture of hydrogen and CO may be also be injected into the blast furnace 1 via hearth tuyere 1*b* as additional reducing gas. (A single tuyere is schematically represented in the figure, whereas in practice, a blast furnace comprises a multitude of tuyeres)

In order to limit the carbon footprint of the known blast furnace operation, the hydrogen, CO or the mixture of hydrogen and CO can be sourced from environmentally friendly sources, such as biofuel partial combustion or reforming.

As indicated earlier, in order to limit $CO_2$ emissions by the blast furnace, hydrogen could appear to be the preferred additional reducing gas. Unfortunately, the cost of substantially pure hydrogen gas is usually inhibitive for this kind of industrial application.

A further technical problem related to hydrogen (and CO) injection into a blast furnace relates to the thermodynamics of the blast furnace process, namely the fact that the efficiency of hydrogen (and CO) usage in the blast furnace rarely exceeds 50%. 50% of the hydrogen injected in the blast furnace thus exits the top of the blast furnace without participating in the reactions. This limits the use of hydrogen in a conventional blast furnace.

Table 1 presents a theoretical comparison, based on process simulation, between operations of a conventional blast furnace injecting 130, 261 and 362 $Nm^3$ hydrogen/ tonne hot metal (thm) into a standard blast furnace with powdered coal injection (PCI) when that hydrogen is used to replace coal while keeping the coke rate constant. Also presented in Table 1 are the cases when 130 and 197 Nm3 of hydrogen are replacing coke while keeping the coal injection (PCI) rate constant.

TABLE 1

| Period (Enter the name of the period) | Units | Reference Final | 11.72 Kg H2 Replacing Coal | 11.72 Kg H2 Replacing Coke | 17.7 Kg H2 Replacing Coke | 23.44 Kg H2 Replacing Coal | 33.61 Kg H2 Replacing Coal |
|---|---|---|---|---|---|---|---|
| Reductant Consumption | | | | | | | |
| Coke rate (small + big) | Kg/thm | 293 | 293 | 265 | 253 | 293 | 293 |
| Fuel Injection Rate | Kg/thm | 197 | 179 | 209 | 215 | 164 | 153 |
| Coal Injection Rate | Kg/thm | 197 | 167 | 197 | 197 | 141 | 120 |
| Hydrogen Injection Rate | Kg/thm | 0 | 11.72 | 11.72 | 17.70 | 23.44 | 32.61 |
| Hydrogen Injection Rate | Nm3/thm | 0 | 130 | 130 | 197 | 281 | 362 |
| Total Fuel Rate | Kg/thm | 490 | 471 | 474 | 468 | 457 | 445 |
| Tuyeres | | | | | | | |
| Blast Volume (Air Only) | Nm3/thm | 832 | 828 | 827 | 814 | 814 | 801 |
| Blast Temperature | ° C. | 1176 | 1176 | 1176 | 1176 | 1176 | 1176 |
| Oxygen Volume Calculated | Nm3/thm | 82.0 | 76.8 | 79.7 | 80.4 | 75.7 | 75.1 |
| Oxygen in the cold blast | % | 27.6 | 27.2 | 27.4 | 27.5 | 27.2 | 27.2 |
| Water Vapour added to Blast | g/Nm3 | 12.23 | 5.00 | 5.00 | 5.00 | 5.00 | 5.00 |
| Raceway Gas Volume (Gosh Gas Volume) | Nm3/thm | 1311 | 1396 | 1413 | 1470 | 1496 | 1573 |
| Bosh Reducing Gas (CO2/(CO + CO2) | Nm3/thm | 633 | 723 | 739 | 803 | 833 | 920 |
| RAFT (Raceway Adiabatic Flame Temperature) | ° C. | 2251 | 2124 | 2089 | 2006 | 1992 | 1901 |
| Top Gas | | | | | | | |
| Volume (dry) | Nm3/thm | 1441 | 1453 | 1459 | 1469 | 1467 | 1477 |
| Temperature | ° C. | 128 | 154 | 176 | 200 | 181 | 200 |
| CO | % | 24.5 | 22.6 | 22.6 | 21.7 | 20.9 | 19.7 |
| CO2 | % | 24.1 | 22.4 | 22.3 | 21.5 | 20.9 | 19.6 |
| H2 | % | 4.3 | 8.5 | 8.9 | 11.4 | 13.0 | 16.5 |
| N2 | % | 47.1 | 46.4 | 46.2 | 45.4 | 45.2 | 44.2 |
| CO2/(CO + CO2) | % | 0.496 | 0.499 | 0.497 | 0.497 | 0.499 | 0.499 |
| BF Operational Results | | | | | | | |
| Gas Utilization at FeO Level | % | 93.0 | 93.0 | 93.0 | 93.0 | 93.0 | 93.0 |
| Calculated Heat Losses | MJ/thm | 408.7 | 408.7 | 408.7 | 408.7 | 408.7 | 408.7 |
| % of Heat Losses in the Lower BF | % | 80.7 | 80.7 | 80.7 | 80.7 | 80.7 | 80.7 |
| Global Direct Reduction Rate | % | 30.8 | 26.1 | 25.4 | 22.2 | 20.6 | 16.2 |
| Direct Reduction Degree of Iron Oxides | % | 29.7 | 24.9 | 24.1 | 20.9 | 19.2 | 14.8 |
| Reduction of CO2 Emission (per tonne HM) | | | | | | | |
| Carbon Consumption | Kg/thm | 423 | 398 | 399 | 388 | 376 | 359 |
| CO2 Emissions | Kg/thm | 1550 | 1459 | 1461 | 1421 | 1378 | 1315 |
| CO2 Savings | Kg/thm | — | 92 | 89 | 130 | 172 | 235 |
| % CO2 Savings | % | — | 5.9 | 5.7 | 8.4 | 11.1 | 15.2 |
| Relative Production Rate | % | 100 | 100 | 100 | 100 | 100 | 100 |
| CO2 for electricity @ 600 g CO2/kWh (not including oxygen) | Kg/thm | 24.0 | 24.0 | 24.0 | 24.0 | 24.0 | 24.0 |
| O2 for electricity @ 600 g CO2/kWh (oxygen) | Kg/thm | 27.1 | 25.3 | 26.3 | 26.5 | 25.0 | 24.8 |
| Total CO2 saved | Kg/thm | 0 | 93 | 90 | 130 | 174 | 237 |
| % CO2 saved | % | — | 5.8 | 5.6 | 8.1 | 10.9 | 14.8 |
| Hydrogen to Oxygen Ratio | | | 1.7 | 1.64 | 2.45 | 3.44 | 4.83 |

TABLE 2

| Units | Iron Production Rate tonne/d | Coke Charge Rate Kg/thm | Coal Injection Rate Kg/thm | Oxygen Volume Required in Blast Furnace Nm3/thm | CO2 Produced kg/thm | Total CO2 Saved With Respect to Conventional BF Tonnes/year | % CO2 Saved % | Additional Hydrogen Injected Nm3/h |
|---|---|---|---|---|---|---|---|---|
| Reference | 5784 | 293 | 146 | 92.2 | 1510 | — | — | — |
| Conventional w/PCL | 5784 | 300 | 189 | 58.1 | 1550 | — | — | — |
| Conventional w/NG | 5784 | 303 | 0 | 173.4 | 1402 | 308971 | 9.8 | — |
| Conventional 100 Nm3 H2/thm | 5784 | 270 | 189 | 63.7 | 1467 | 242922 | 7.7 | 24098 |
| Conventional 200 Nm3 H2/thm | 5784 | 240 | 189 | 69.8 | 1385 | 483163 | 15.4 | 48197 |
| Conventional 300 Nm3 H2/thm | 5784 | 210 | 189 | 74.9 | 1259 | 814611 | 26.0 | 72295 |

TABLE 2-continued

| | | | | | | | | |
|---|---|---|---|---|---|---|---|---|
| ULCOS Version 4 | 6383 | 209 | 190 | 239.6 | 1258 | 903884 | 26.1 | — |
| ULCOS 100 Nm3/t H2 Injection | 7019 | 185 | 190 | 227.5 | 1180 | 1258836 | 33.1 | 29246 |
| ULCOS 100 Nm3/t H2 Injection 74 Kg/thm PCL | 6344 | 263 | 74 | 203.9 | 1082 | 1138784 | 33.1 | 26432 |
| ULCOS 200 Nm3/t H2 Injection | 7506 | 169 | 190 | 219.3 | 1127 | 1539163 | 37.8 | 62546 |
| ULCOS 200 Nm3/t H2 Injection No PCL | 6812 | 291 | 1 | 177.4 | 947 | 1463335 | 39.6 | 56764 |
| ULCOS 300 Nm3/t H2 Injection | 7866 | 170 | 164 | 206.0 | 1053 | 1810700 | 42.4 | 98319 |
| ULCOS 300 Nm3/t H2 Injection NO PCL | 7526 | 258 | 1 | 160.6 | 840 | 2006584 | 49.2 | 94071 |
| ULCOS 400 Nm3/t H2 Injection w 151 Kg PCL | 8197 | 167 | 151 | 197.2 | 1003 | 2041574 | 45.9 | 136624 |
| ULCOS 400 Nm3/t H2 Injection w 94 Kg PCL | 8188 | 195 | 94 | 180.0 | 920 | 2176259 | 49.0 | 136472 |

| | Additional H2 | Total Oxygen Requirements (80% hot metal/ 20% Scrap 93% yield) | | Total O2 Requirement For BF | Additional O2 Surplus/Deficit | Additional O2 Surplus/Deficit |
|---|---|---|---|---|---|---|
| Units | Produced/Additional O2 Required H2/O2 Ratio | Blast Furnace Nm3/h | L-D Converter (55 Nm3/thm) Nm3/h | and LD Converter tonnes/day | from H2O Decomp NmS/h | from H2O Decomp tonnes/day |
| Reference | — | 22211 | 15408 | 1289 | | |
| Conventional w/PCL | — | 13996 | 15408 | 1008 | | |
| Conventional w/NG | — | 41791 | 15408 | 1960 | | |
| Conventional 100 Nm3 H2/thm | 1.57 | 15348 | 15408 | 1054 | −18707 | −641 |
| Conventional 200 Nm3 H2/thm | 2.87 | 16816 | 15408 | 1104 | −8125 | −278 |
| Conventional 300 Nm3 H2/thm | 4.01 | 18050 | 15408 | 1147 | 2690 | 92 |
| ULCOS Version 4 | — | 63714 | 17004 | 2766 | | |
| ULCOS 100 Nm3/t H2 Injection | 0.44 | 66532 | 18699 | 2921 | −70608 | −2420 |
| ULCOS 100 Nm3/t H2 Injection 74 Kg/thm PCL | 0.49 | 53894 | 16900 | 2426 | −57578 | −1973 |
| ULCOS 200 Nm3/t H2 Injection | 0.91 | 68582 | 19995 | 3036 | −57304 | −1964 |
| ULCOS 200 Nm3/t H2 Injection No PCL | 1.13 | 50347 | 18147 | 2347 | −40112 | −1375 |
| ULCOS 300 Nm3/t H2 Injection | 1.46 | 67516 | 20954 | 3032 | −39310 | −1347 |
| ULCOS 300 Nm3/t H2 Injection NO PCL | 1.87 | 50347 | 20049 | 2412 | −23360 | −801 |
| ULCOS 400 Nm3/t H2 Injection w 151 Kg PCL | 2.03 | 67352 | 21838 | 3057 | −20879 | −716 |
| ULCOS 400 Nm3/t H2 Injection w 94 Kg PCL | 2.22 | 61406 | 21814 | 2852 | −14984 | −514 |

Table 2 demonstrates the reduced requirement for external oxygen at the blast furnace and at the L-D Converter as illustrated in FIG. 2 when oxygen from the water decomposition process is used in the steelmaking plant.

As shown in Table 2, if oxygen from the water decomposition process is used for the blast furnace and the L-D converter, the need for external oxygen, typically from an air separation plant, to meet the oxygen requirement of the steel plant is greatly reduced or non-existent.

For most of the embodiments illustrated in Table 2, the use of water decomposition to meet the entire requirement of the blast furnace for additional hydrogen results in a generation of oxygen which is insufficient to meet the (additional) oxygen requirement of the blast furnace and the converter. Consequently, additional oxygen must be obtained from a further oxygen source, such as an ASU, in order to meet said requirement. However, the amount of oxygen to be obtained from said further oxygen source is drastically reduced.

However, when the use of water decomposition to meet the entire requirement of the blast furnace and/or for the converter (if present) results in the generation of oxygen in excess of the additional oxygen requirement of the blast furnace (and, if applicable, the converter), surplus generated oxygen may advantageously be used in other processes/installations of the iron- or steelmaking plant and/or be sold to generate revenue. The present invention thus provides a method for reducing $CO_2$ emissions from an iron- or steelmaking plant comprising an iron furnace set (IFS) by means of the injection into the IFS of a non-carbon-based reducing agent and this at lower overall cost. It also greatly reduces the amount of external oxygen produced by ASU, VSA, VPSA or any other method to complete the oxygen requirement of the iron- or steelmaking plant. In doing this the amount of indirect $CO_2$ emissions from oxygen production are also avoided or reduced. The carbon footprint of the iron- or steelmaking plant can be further reduced by using low-carbon-footprint electricity as described above.

A method according to the present invention is illustrated in FIG. 2 with respect to an IFS containing one or more TGRBFs. Again, blast furnace 1 is charged from the top with coke and iron ore 2 which descend in the blast furnace 1. Substantially pure oxygen 22 and pulverized coal (or another organic fuel) 23 are injected into blast furnace 1 via hearth tuyeres 1*b*. The blast furnace gas (BFG) 3 exits the blast furnace 1 and travels to an initial dust removal unit 4 for course dust particles, followed by a second dust removal system 5 that removes the finer dust particles to produce a "clean gas" 6.

Clean gas 6 is optionally dewatered before entering the CO2-removal system 7. The CO2-removal system 7 can be a vacuum pressure swing adsorption system (VPSA), a pressure swing adsorption system (PSA) or a chemical absorption system such as an amines-based absorption system or any other type of system that removes most of the CO2 from the (dean) BFG 6. Typically, less than 15% vol; preferably less than 10% vol and more preferably less than 3% vol CO2 will remain in the decarbonated BFG 9. CO2-removal system 7 thus splits the dean gas stream 6 into two streams: a CO2-enriched tail gas 8 and a CO2-lean product gas 9.

The CO2-rich tail gas 8 is removed from the blast furnace operation process through evacuation line 8*a* equipped with control valve 8*b*. The CO2-lean product gas stream (decarbonated BFG) 9 exits the CO2-removal system 7 at elevated pressure (typically 4-8 bar). The decarbonated BFG $ is sent to hot stoves 20, where it is heated before being sent to hearth tuyeres 1*b* for injection into the blast furnace 1. In accordance with the invention, water 10 and suitable electrolyte 10*a* are mixed to produce an aqueous solution 11 that has an optimum electrical potential for water dissociation into hydrogen and oxygen when a suitable electrical potential (voltage) is applied to the solution 11, i.e. for water electrolysis.

Pump 12 generates a pressurized flow 13 of solution 11 towards electrolysis installation 14 (high-pressure electrolysis). As a consequence, the generated hydrogen 15 and oxygen 22*a* streams leaving electrolysis installation 14 are likewise pressurized, rendering said gas streams suitable for downstream use without compression or with reduced additional compression of the hydrogen 15, respectively the oxygen 22*a*.

After electrolysis of solution 13 to hydrogen 15 and oxygen 22*a*, the hydrogen 15 is mixed with decarbonated BFG 9 so as to fortify the latter. The oxygen 22*a* is injected as oxygen stream 22*c* into blast furnace 1 where it is used as a combustion oxidizer and/or as oxygen stream 22*d* into converter 50 also present in the plant, where it is used as a decarburization agent.

Depending on the pressure at which hydrogen 15 and oxygen 22*a* streams leave electrolysis installation 14, said gases may or may not need to be pressurized or depressurized to an appropriate pressure for combination with decarbonated BFG stream 9 and/or for injection into the blast furnace 1 and/or converter 50. Gas pressurization may be achieved in a compressor, gas depressurization in an expander.

FIG. 2 shows an embodiment whereby both hydrogen stream 15 and oxygen stream 22*a* need to be depressurized. Hydrogen stream 15 is depressurized using gas expander 17, Oxygen stream 22*a* is depressurized using further gas expander 22*b*.

It will be appreciated that when generated oxygen 22*a* is divided to be injected in multiple installations of the steelmaking plant, e.g. in a blast furnace and in a converter or in an EAF for melting scrap, pressurization or depressurization may be required for only some of said installations or may apply differently to different installations, in which case separate pressurization or depressurization equipment may be provided for the different installations.

Depending on the pressure drop between the entrance and exit of the two expanders 17 and 22*b*, energy from the expander 17 and expander 22*b* could be used to generate electricity, thus further improving the (energy) efficiency of the plant. Fortified gas stream 19 is obtained by mixing of decarbonated BFG stream 9 with depressurized hydrogen stream 18.

In the illustrated embodiment, hot stoves 20 are heated by the combustion of a diverted portion 25 of the CO2-rich tail gas 8 with air stream 28. Valves 8*b* and 25*a* control the portion 25 of the CO2-rich tail gas 8 which is thus diverted.

A portion 26 of fortified gas stream 19 may, as shown, be diverted for making a "mixed gas" 27 that can be used as a low-heating-value fuel for heating the stoves as such or in combination with other fuels, such as coke oven gas. In that case, portion 26 (if needed) of fortified gas stream 19 used in the mixed gas 27 is regulated using valve 26*a*. Care is taken so that mixed gas 27 has a heating value appropriate for heating stoves 20. The heating value of mixed gas 27 is typically arranged to be low (5.5-6.0 MJ/Nm3) and the mixed gas preferably has (a) a low content of hydrocarbons to prevent vibration in the stove combustion chamber and (b) a significant content of CO and H2 for facilitating smooth combustion.

As shown, another portion of fortified gas stream 19 (stream 16) can be used as fuel to heat electrolysis installation 14 if higher electrolysis temperatures are needed (high-temperature electrolysis), though other means may (also) be provided to that effect. The flow rate of stream 16 is regulated using valve 26*b*. Air stream 28 is used as an oxidant to combust stream 27 for heating the stoves 20. In addition, air stream 24 is used as an oxidant to combust stream 16 for heating electrolysis installation 14, if necessary.

Fortified gas stream 19 is heated in stoves 20 to create gas streams 21 and optionally 29 having a temperature greater than 700° C. and as high as 1300° C. However, the preferred temperature of stream 21 is between 850° C. and 1000° C. and more preferably 880° to 920° C. in order to have a sufficiently high temperature to promote rapid iron ore reduction while having a sufficiently low temperature to prevent possible reduction of the oxide refractory lining the pipeline to the blast furnace.

Optionally a portion 29 of heated fortified gas stream 19 (containing recycled product gas 9 and generated hydrogen 18) is injected into the shaft tuyere 1*c* to combine inside the blast furnace with the gases produced at the hearth tuyeres to produce a reducing gas 1*d* that ascends the inside of blast furnace 1, contacts the iron ore and coke 2 and reduces the iron oxides contained in the ore to metallic iron. Gas stream 29 may or may not be used depending on the configuration of the particular TGRBF. The distribution of flow rates between streams 21 and 29 are governed by valve 30.

Oxygen stream 22*c* may provide all of the oxygen injected into blast furnace 1. The oxygen injected into blast furnace 1 may also entirely or partially come from an external oxygen supply, for example, an Air Separation Unit (ASU), such as a Vacuum Swing Adsorption (VSA) unit, a Vacuum Pressure Swing Adsorption (VPSA) unit, an oxygen pipeline etc.

Preferably, at least part of the oxygen stream 22*a* produced on-site (i.e. inside the iron- or steelmaking plant) by water decomposition (more specifically by water electrolysis in installation 14) is injected into the blast furnace 1 as oxygen stream 22*c*.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A method of operating an ironmaking or steelmaking plant comprising an ironmaking furnace set comprising one or more furnaces in which iron ore is transformed into liquid hot metal by means of a process which includes iron ore reduction, melting and off-gas generation, the ironmaking or steelmaking plant, the method comprising the steps of:

a. charging the ironmaking furnace set with iron ore and coke, b. injecting oxidizing gas into the ironmaking furnace set, c. producing an off-gas and decarbonating the off-gas downstream of the ironmaking furnace set thereby obtaining a $CO_2$-enriched tail gas stream and a decarbonated off-gas stream containing not more than 10% vol $CO_2$, d. injecting at least 50% of the decarbonated off-gas stream back into the ironmaking furnace set as a reducing gas recycle stream, e. generating hydrogen and oxygen by means of water decomposition, f. injecting at least part of the hydrogen generated in step in step (e) combined with at least a part of the decarbonated off-gas into the ironmaking furnace set, and g. injecting at least part of the generated oxygen into the ironmaking furnace set and/or a converter as oxidizing gas.

2. The method according to claim 1, whereby at least part of the hydrogen generated in step (e) which is injected into the ironmaking furnace set is mixed with the reducing gas recycle stream before the gas mixture so obtained is injected into the ironmaking furnace set.

3. The method according to claim 1, wherein:

h. the gas recycle stream or the mixture of hydrogen generated in step (e) with the gas recycle stream is heated upstream of the ironmaking furnace set to a temperature between 700° C. and 1300° C.

4. The method according to claim 3, wherein:

i. a low-heating-value gaseous fuel having a heating value of from 2.8 to 7.0 $MJ/Nm^3$ is produced containing (i) at least a portion of the tail gas stream and (ii) a second part of the hydrogen generated in step (e), said low-heating-value gaseous fuel being used to heat hot stoves used for heating the gas recycle stream.

5. The method according to claim 1, whereby a ratio between:

(i) the hydrogen generated in step (e) and injected into the ironmaking furnace set and (ii) the oxygen generated in step (e) and injected into the ironmaking furnace set and/or the converter in step (g) is between 1.50 and 2.50.

6. The method according to claim 1, whereby a ratio between:

(i) the hydrogen generated in step (e) and injected into the ironmaking furnace set and (ii) the oxygen generated in step (e) and injected into the ironmaking furnace set in step (g) is between 1.75 and 2.25.

7. The method according to claim 1, wherein pulverized coal and/or another organic combustible substance is injected into the blast furnace by means of tuyeres.

8. The method according to claim 1, wherein all or part of the generated hydrogen which is injected into the ironmaking furnace set is injected into the ironmaking furnace set via tuyeres.

9. The method according to claim 1, wherein all or part of the oxygen generated in step (e) is mixed with oxygen-containing gas not generated in step (e) so as to obtain a mixture which is injected as oxidizing gas into the ironmaking furnace set.

10. The method according to claim 1, wherein the oxidizing gas which is injected into the ironmaking furnace set in step (b) consists of oxygen generated in step (e).

11. The method according to claim 1, wherein in step (e), hydrogen and oxygen are generated by biological and/or electrolytic water decomposition.

12. The method of claim 11, wherein in step (e), hydrogen and oxygen are generated by electrolytic water decomposition at a pressure above atmospheric pressure and/or at a temperature above ambient temperature.

13. The method according to claim 1, wherein the reducing gas is injected into the ironmaking furnace set via tuyeres.

14. The method according to claim 1, wherein the ironmaking furnace set comprises one or more blast furnaces.

15. The method according to claim 1, wherein the hydrogen generated in step (e) consists of at least 70% vol of $H_2$ molecules.

* * * * *